US005394334A

United States Patent [19]

Simon

[11] Patent Number: 5,394,334

[45] Date of Patent: Feb. 28, 1995

[54] MULTISTATION TEXTILE MACHINE, AND PROCESS FOR PREPARING FOR OPERATION OF THE TEXTILE MACHINE

[75] Inventor: Karsten Simon, Mönchengladbach, Germany

[73] Assignee: W. Schlafhorst AG & CO., Möenchengladbach, Germany

[21] Appl. No.: 241,386

[22] Filed: May 10, 1994

Related U.S. Application Data

[63] Continuation of Ser. No. 73,281, Jun. 7, 1993, abandoned, which is a continuation of Ser. No. 576,079, Aug. 31, 1990, abandoned.

[30] Foreign Application Priority Data

Aug. 31, 1989 [DE] Germany ..... 3928831

[51] Int. Cl.[6] ..... G06F 15/46

[52] U.S. Cl. ..... 364/470; 57/264; 364/132

[58] Field of Search ..... 364/470, 131–136, 364/138; 57/263, 264, 265

[56] References Cited

U.S. PATENT DOCUMENTS

| | | | |
|---|---|---|---|
| 3,922,642 | 11/1975 | Tooka | 364/470 X |
| 4,253,148 | 2/1981 | Johnson et al. | 364/133 |
| 4,454,577 | 6/1984 | Constantini et al. | 364/200 |
| 4,472,783 | 9/1984 | Johnstone et al. | 364/132 |
| 4,497,031 | 1/1985 | Froehling et al. | 364/557 |
| 4,736,324 | 4/1988 | Sainen et al. | 364/470 |
| 4,819,149 | 4/1989 | Sanik et al. | 364/132 |
| 4,835,699 | 5/1989 | Mallard | 364/470 |
| 4,943,927 | 7/1990 | Yarita et al. | 364/132 |
| 4,944,033 | 7/1990 | Erni | 364/470 |
| 4,972,463 | 11/1990 | Danielson et al. | 364/132 |
| 4,980,806 | 12/1990 | Taylor et al. | 364/132 |
| 5,034,897 | 7/1991 | Sainen | 364/470 |

FOREIGN PATENT DOCUMENTS 2032968 5/1980 United Kingdom .

*Primary Examiner*—Joseph Ruggiero

*Attorney, Agent, or Firm*—Herbert L. Lerner; Laurence A. Greenberg

[57] ABSTRACT

A multistation textile machine with a control and information processing system includes production stations each having at least one control device, control computers each being assigned to a production station and connected to the control device, a data bus connected to the control computers, and a CPU connected to the data bus having an adjusting device for set-point operating data to be transmitted over the data bus to the control computers. The control computers each control a production station in accordance with input set-point operating data and with a problem program in communication with the production station. The control computers each receive and process actual data of the production station and communicate with the production station and the CPU. The CPU transmits set-point operating data of the production stations and a complete problem program for the control computers over the data bus to the control computers. The control computers operate according to the complete problem program transmitted from the CPU over the data bus, while taking into account the set-point operating data of the production station transmitted by the CPU over the data bus.

13 Claims, 1 Drawing Sheet

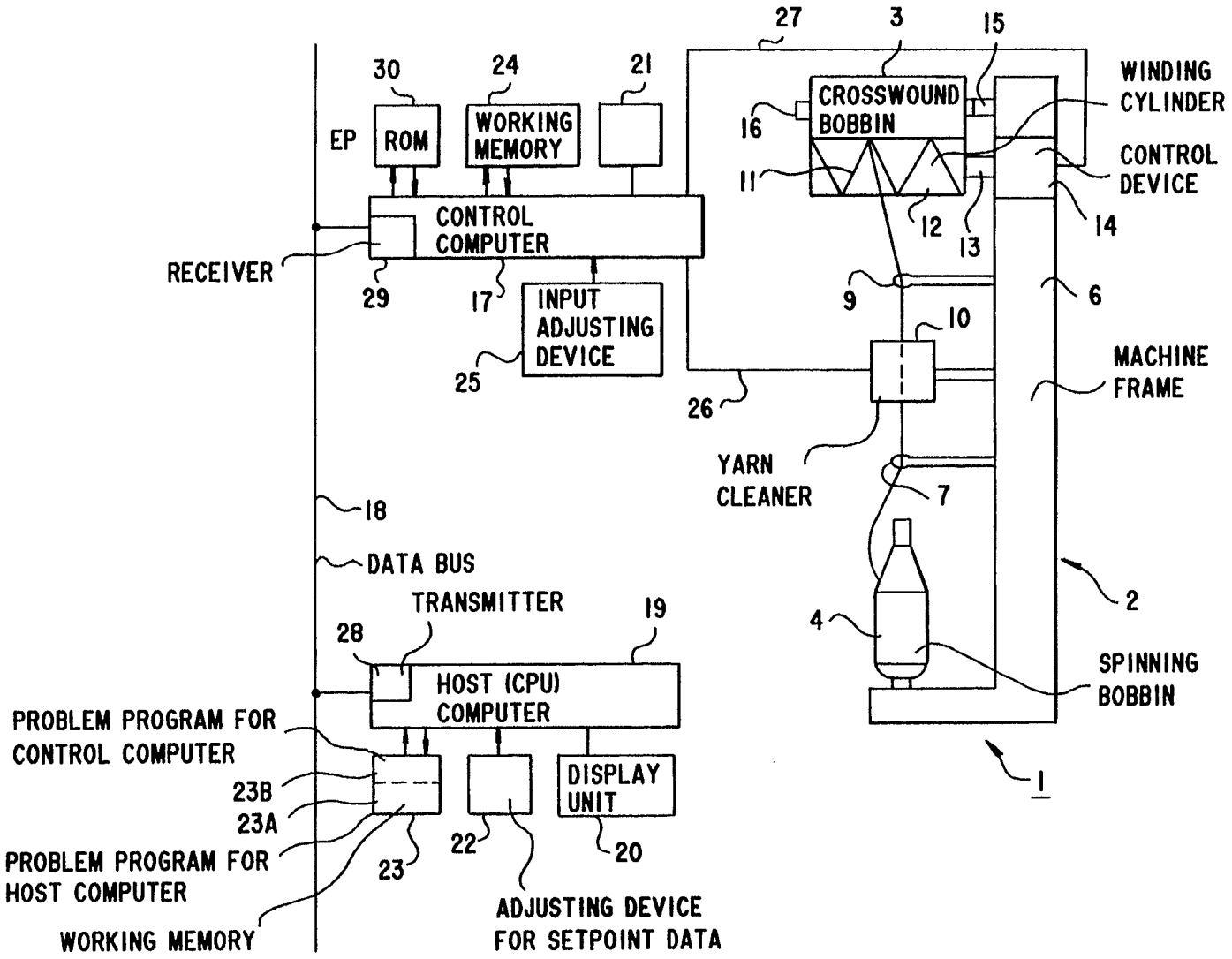
WINDING CYLINDER
CONTROL DEVICE
MACHINE FRAME
SPINNING BOBBIN
CROSSWOUND BOBBIN
YARN CLEANER
WORKING MEMORY
ROM
EP
CONTROL COMPUTER
INPUT ADJUSTING DEVICE
RECEIVER
DATA BUS
TRANSMITTER
HOST (CPU) COMPUTER
DISPLAY UNIT
ADJUSTING DEVICE FOR SETPOINT DATA
PROBLEM PROGRAM FOR CONTROL COMPUTER
PROBLEM PROGRAM FOR HOST COMPUTER
WORKING MEMORY
1
2
3
4
6
7
9
10
11
12
13
14
15
16
17
18
19
20
21
22
23
23A
23B
24
25
26
27
28
29
30

MULTISTATION TEXTILE MACHINE, AND PROCESS FOR PREPARING FOR OPERATION OF THE TEXTILE MACHINE

CROSS REFERENCE TO RELATED APPLICATIONS

This is a file wrapper continuation of application Ser. No. 08/073,281, abandoned filed Jun. 7, 1993, which was a continuation of application Ser. No. 07/576,079, filed Aug. 31, 1990, now abandoned.

The invention relates to a multistation textile machine having a control and information processing system and a process for preparing for operation of the textile machine, in which the individual production stations of the textile machine are assigned control computers that are connected over a data bus to a CPU which has an adjusting device for set-point operating data that can be transmitted over the data bus to the control computer; the control computer is set up for controlling the production station in accordance with input set-point operating data and in accordance with a problem program in dialog with the production station, and to this end is set up for receiving and processing actual data of the production station and for a dialog with the production station and the CPU and it is connected to at least one control device of the production station.

Such multistation textile machines include automatic bobbin winders, automatic spinners, or very generally machines that produce cross-wound bobbins or cheeses, which have a plurality of production stations. The problems of software maintenance increase with the number of production stations. The expenditure of time for functional improvement and software troubleshooting increases disproportionately.

Upon batch changes, the problem of machine conversion arises. Mechanical changes must sometimes be made in the multistation textile machine. Moreover, the set-point operating data must be changed. The problem programs or operating environment of the central processor, or CPU, and the control computer are fixed, and it is difficult in several respects and often no longer even possible for the same problem program to enable operation with different batches. As a result, the textile machine becomes inflexible in terms of a rapid conversion from one batch to the next.

It is accordingly an object of the invention to provide a multistation textile machine and a process for preparing for operation of the textile machine, which overcome the hereinafore-mentioned disadvantages of the heretofore-known methods and devices of this general type and which improve and speed up software maintenance.

However, the invention is based on the recognition that a more comprehensive, more flexible and faster conversion from one batch to another should be performed not only by a suitable change of the set-point operating data but also of the problem programs of the computer, and that ways and means must be found to accomplish this in order to make the conversion of the multistation textile machine fast and reliable over a wide range of different batches, making it more or less foolproof by precluding opportunities for mistakes, and thus adapting it quickly to any sudden change in trends, and that this should be connected with the improvement in the software maintenance.

With the foregoing and other objects in view there is provided, in accordance with the invention, a multistation textile machine with a control and information processing system, comprising production stations each having at least one control device, control computers each being assigned to a respective one of the production stations and connected to the at least one control device of the production station to which it is assigned, a data bus connected to the control computers, a CPU or host computer being connected to the data bus and having an adjusting device for set-point operating data to be transmitted over the data bus to the control computers; the control computers each having means for controlling the production station to which it is assigned in accordance with input set-point operating data and in accordance with a problem program in communication or dialog with the production station; the control computers each having means for receiving and processing actual data of the production station and for communicating or entering into dialog with the production station and the CPU; the CPU having means for transmitting set-point operating data of the production stations and for transmitting a complete problem program for the control computers over the data bus to the control computers; and the control computers having means for operating according to the complete problem program transmitted from the CPU over the data bus, while taking into account the set-point operating data of the production station likewise transmitted by the CPU over the data bus.

In accordance with another feature of the invention, the CPU computer has a transmitter and the control computer has a receiver for the data of a program code and for the data of a code for the set-point operating data of the production station.

In accordance with a further feature of the invention, each control computer has a read only memory with a bootstrap program and a working memory for receiving the data representing its problem program, and the read only memory is connected to the working memory and is set up for jumping the bootstrap program to the just-stored problem program after the end of the data transmission.

With the objects of the invention in view, there is also provided a process for preparing for operation of a multistation textile machine with a control and information processing system, including production stations each having at least one control device, control computers each being assigned to a respective one of the production stations and connected to the at least one control device of the production station to which it is assigned, a data bus connected to the control computers, and a CPU being connected to the data bus and having an adjusting device for set-point operating data to be transmitted over the data bus to the control computer, which comprises controlling the production stations with the control computer assigned thereto with input set-point operating data and in accordance with a problem program in communication with the production station, receiving and processing actual data of the production station and communicating with the production station and the CPU with the control computer, selectively inputting, selecting or replacing a problem program in the CPU in order to prepare the operation of the textile machine, then transmitting a problem program for the control computer from the CPU over the data bus to the control computer, and transmitting the set-point operating data or the changes in the set-point operating data of the production station to the control computer simultaneously in conjunction with the problem program or at a time interval after the problem program.

Where the control computer is mentioned in singular form herein, it refers to the particular control computer of the production station involved. Naturally, the same problem program may be selected for all of the control computers of all of the production stations. However, groups of production stations can also be formed. Their control computers could then be fed a different problem program. This is performed in conjunction with an addressing process that is known per se. In accordance with a concomitant mode of the invention, there is provided a process which comprises preparing for the operation of the multistation textile machine by the "program download" process, wherein a program code specified for the control computer is sent by the CPU over the data bus; the code is optionally received by a plurality of control computers or all of the control computers from their bootstrap programs and stored in their working memories; and after the end of the transmission, the bootstrap program of the receiving control computer then jumps to the just-stored problem program, and the control computer then behaves in the same way as if a new problem program had been installed in it in the conventional manner, for example by a manual EPROM replacement.

Manually replacing plug-in elements, which is mentioned herein, is a very disadvantageous alternative, because mistakes cannot be precluded with manual replacements, and this kind of replacement entails an unacceptably high labor cost, if a large number of production stations is involved. Keeping large quantities of different plug-in units in reserve for the virtually unlimited possibilities of batch changes would also entail an unacceptable expenditure for replacement parts, all of which is avoided by the invention.

The invention has the further advantage of achieving sensitive adaptation to various batches by providing that only the problem programs, but not the set-point operating data, are changed from one case to another.

Other features which are considered as characteristic for the invention are set forth in the appended claims.

Although the invention is illustrated and described herein as embodied in a multistation textile machine and a process for preparing for operation of the textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a diagrammatic and block circuit diagram showing one exemplary embodiment of the invention.

Referring now to the single FIGURE of the drawing in detail, there is seen a multistation textile machine 1 which is constructed as an automatic bobbin winder with a plurality of production stations 2. Each production station 2 serves to produce cross-wound bobbins or cheeses 3, from spinning bobbins 4. Each production station 2 has a machine frame 6. The spinning bobbin 4 is mounted on a holder at the foot of the machine frame 6. A thread or yarn being paid out passes through a yarn eyelet 7, a cleaner 10, and a further yarn eyelet 9, and from there reaches a reversing groove 11 of a winding cylinder 12, having a shaft 13 which is driven by an electric motor that is integrated into a control device 14. The machine frame 6 also carries a holder 15 of a pivotable creel 16, which rotatably supports the cheese 3. The cheese 3 rests on the winding cylinder 12 due to its own and due to the weight of the creel 16. The cheese 3 is driven by the winding cylinder 12.

Each production station, thus including the production station 2, is assigned a control computer 17. All of the control computers are connected to a CPU or host computer 19 over a data bus 18. The CPU 19 is provided with a separate data memory, a display unit 20, an adjusting device 22 for providing set-point operating data for the control computers 17 or production stations 2, and a working memory 23, among other facilities. The working memory 23 has a part 23A containing the problem program or operating environment of the CPU 19, and a part 23B containing the problem or problem programs or operating environment of the control computers 17.

The set-point operating data adjusted at the adjusting device 22 can be transmitted to the control computers 17 over the data bus 18.

The control computers 17 are set up for controlling the production station 2 in accordance with input set-point operating data and in accordance with a problem program in dialog with the production station 2. The set-point operating data may be selectively specified by the CPU 19 or input at an adjusting device 25 of the control computer 17.

In order to provide the dialog with the production station 2, the control computer 17 is connected both to the cleaner 10 over a line 26, and to the control device 14 over a line 27, so that it can receive and process actual data of the production station.

The CPU 19 has a transmitter 28 and the control computer 17 has a receiver 29 for the data of a program code and for the data of a code for the set-point operating data of the production station 2.

In order to receive the data representing its problem program, each control computer 17 has a read only memory 30 equipped with a bootstrap program and a working memory 24.

The CPU 19 is set up for transmitting set-point operating data, which are adjusted at the adjusting device 22, and for transmitting the complete problem program of the control computers, which can be selected through the working memory 23, over the data bus 18 to the control computers 17. The control computer 17 is set up for operating according to the complete problem program transmitted over the data bus 18 by the CPU, taking into account the set-point operating data of the production station which is likewise transmitted by the CPU 19 over the data bus 18. The read only memory 30 of the control computer 17 is internally connected to the working memory 24 and is set up for jumping from the bootstrap program to the just-stored problem program after the end of the data transmission.

In order to prepare for the operation of the textile machine 1 or in the case of software maintenance, the problem program of the CPU and the problem program of the control computer 17 are selected or input at the CPU 19 in the working memory 23, and then the problem program of the control computer 17 is transmitted from the CPU 19 through the transmitter 28 and over the data bus 18 to the receiver 29. Simultaneously in conjunction with the problem program or at a time interval, the set-point operating data or the changes in the data of the production station 2 may be transmitted to the control computer 17. This is performed by the "program download" process, wherein the CPU 19 transmits a program code specified for the control computer 17 over the data bus 18, for example in response to back and forth transmissions. Optionally, several or all of the control computers 17 simultaneously take the code from the bootstrap program of the read only memory 30 and store it in the working memory 24. After the end of the transmission, the bootstrap program of the receiving control computer 17 then jumps to the just-stored problem program, and the control computer 17 then behaves exactly as if a new problem program had been installed in it in the conventional manner, for example by manual EPROM replacement.

For instance, the problem program may act over the line 27 to provide for the control device 14 to be made to run the drive motor of the winding cylinder 12 up to speed as quickly as possible and keep it at as high an rpm as possible, until the cleaner 10 ascertains that the time interval between successive yarn breaks is becoming shorter, for instance because the supply of yarn of the spinning bobbin 4 is running out. The control computer 17 then acts over the line 27 to cause the control device 14 to gradually reduce the winding speed. The control device 14 can also enter into dialog with the control computer 17, for instance if it includes a revolution counter that reports over the line 27 to the control computer 17 once the specified bobbin fullness has been attained, so that the control computer 17 can then emit a shutoff signal and the appropriate indicator signals. The control computer 17 also causes the activation of a non-illustrated yarn splicer for resplicing the yarn as quickly as possible after a yarn break or cleaning cut, and after the re-establishment of the yarn connection it dictates the most advantageous run-up curve to the most advantageous operating speed for that situation to the control device 14.

I claim:

1. Multistation cross-wound bobbin producing machine comprising a plurality of cross-wound bobbin producing stations each having at least one control device, a plurality of production station control computers each being assigned to a respective one of said cross-wound bobbin producing stations and connected to said control device of said cross-wound bobbin producing station, a data bus connected to said control computers, a central control and information processing system having a central host computer being connected to said data bus and having an adjusting device for entering set-point operating data to be transmitted over said data bus to said control computers; said control computers each having means for controlling said cross-wound bobbin producing station to which it is assigned in accordance with the input set-point operating data, a problem correcting program in said host computer in communication with said cross-wound bobbin producing station via said data bus; said control computers each having a data receiver for receiving and processing set point operating data for said cross-wound bobbin producing station and for communicating with said cross-wound bobbin producing station and said host computer; a data transmitter in said host computer connected to said data bus for transmitting set-point operating data for said cross-wound bobbin producing stations and for transmitting a problem correcting program to said control computers via said data bus to said control computers; said control computers having means for operating according to the problem correcting program transmitted from said host computer via said data bus, in response to the set-point operating data of said cross-wound bobbin producing station transmitted by said host computer over said data bus.

2. Multistation textile machine according to claim 1, wherein said host computer has a transmitter and said control computer has a receiver for data of a program code and for data of a code for the set-point operating data of said cross-wound bobbin producing station.

3. Multistation textile machine according to claim 1, wherein each of said control computers has a read only memory with a bootstrap program and a working memory for receiving data representing its problem correcting program, and said read only memory is connected to said working memory and has means for jumping the bootstrap program to the stored problem correcting program after the end of a data transmission.

4. Multistation spinning and bobbin winder comprising a control and information processing system, a plurality of cross-wound bobbin producing stations each having at least one control device, a plurality of control computers each being assigned to a respective one of said cross-wound bobbin producing stations and connected to said at least one control device of said cross-wound bobbin producing station to which it is assigned, a data bus connected to said control computers, a host computer being connected to said data bus and having an adjusting device for entering set-point operating data to be transmitted over said data bus to said control computers; said host computer having means for transmitting set-point operating data of said cross-wound bobbin producing stations and for transmitting a complete problem correcting program for said control computers over said data bus to said control computers; said control computers having means for operating according to the complete problem correcting program transmitted from said host computer over said data bus and for controlling said cross-wound bobbin producing station to which it is assigned in response to the set-point operating data of said cross-wound bobbin producing station transmitted by said host computer over said data bus.

5. Process for preparing for operation of a multistation spinning and bobbin winder comprising a control and information processing system, a plurality of cross-wound bobbin producing stations each having at least one control device, a plurality of control computers each being assigned to a respective one of the cross-wound bobbin producing stations and connected to the at least one control device of the cross-wound bobbin producing station to which it is assigned, a data bus connected to the control computers, a host computer being connected to the data bus and having an adjusting device for transmitting set-point operating data to the control computers, the method which comprises the steps of controlling the cross-wound bobbin producing stations with the control computers assigned thereto with input set-point operating data in accordance with a problem correcting program in communication with the cross-wound bobbin producing stations, the control computers receiving and processing actual data for the cross-wound bobbin producing station from the host computer, selectively inputting, selecting or replacing the problem correcting program in the host computer, then transmitting the problem correcting program to the control computer from the host computer over the data bus, and transmitting the set-point operating data and changes in the set-point operation data of the cross-wound bobbin producing station to the control computer.

6. Process according to claim 5, which comprises carrying out the step of transmitting the set-point operating data or the changes in the set-point operating data of the cross-wound bobbin producing station to the control computer simultaneously in conjunction with the problem program.

7. Process according to claim 5, which comprises carrying out the step of transmitting the set-point operating data or the changes in the set-point operating data of the cross-wound bobbin producing station to the control computer at a time interval after the problem program.

8. Process according to claim 5, which comprises preparing for the operation of the multistation textile machine with a program download process by transmitting a program code specified for the control computer from the host computer over the data bus; optionally receiving the code at least at a plurality of the control computers from the bootstrap programs of the control computers and storing the code in working memories of the control computers; and then Jumping the bootstrap program of the receiving control computer to the just-stored problem correcting program and operating the control computer as if a new problem correcting program had been installed therein, after the end of the transmission.

9. Process according to claim 8, which comprises performing the step of receiving the code at all of the control computers.

10. Process according to claim 8, which comprises carrying out the step of installing manually in the computer an EPROM having stored therein the problem correcting program, and operating the control computer with the problem program stored in the EPROM.

11. Process for preparing for operation of a multistation cross-wound bobbin producing machine with a control and information processing system, including a plurality of cross-wound bobbin producing stations each having at least one control device, a plurality of control computers each being assigned to a respective one of the cross-wound bobbin producing stations and connected to the at least one control device of the cross-wound bobbin producing station to which it is assigned, a data bus connected to the control computers a host computer being connected to the data bus and having an adjusting device for entering set-point operating data to be transmitted over the data bus to the control computers; the method which comprises the steps of selectively inputting, selecting or replacing a problem correcting program in the host computer, then transmitting a problem correcting program for the control computer from the host computer over the data bus to the control computer, and transmitting the set-point operating data or the change in the set-point operating data of the cross-wound bobbin producing station to the control computer.

12. Process according to claim 11, which comprises carrying out the step of transmitting the set-point operating data or the changes in the set-point operating data of the cross-wound bobbin producing station to the control computer simultaneously in conjunction with the problem correcting program.

13. Process according to claim 11, which comprises carrying out the step of transmitting the set-point operating data or the changes in the set-point operating data of the cross-wound bobbin producing station to the control computer at a time interval after the problem correcting program.

* * * * *